US006863201B2

(12) United States Patent
Esqueda

(10) Patent No.: US 6,863,201 B2
(45) Date of Patent: Mar. 8, 2005

(54) BACKPACK FOR CARRYING HARD-SHELL HEADGEAR

(76) Inventor: Adrian Esqueda, 306 E. M St., Wilmington, CA (US) 90744

( * ) Notice: Subject to any disclaimer, the term of this patent is extended or adjusted under 35 U.S.C. 154(b) by 111 days.

(21) Appl. No.: 10/323,161

(22) Filed: Dec. 18, 2002

(65) Prior Publication Data

US 2004/0118891 A1 Jun. 24, 2004

(51) Int. Cl.[7] ..... A45C 15/00

(52) U.S. Cl. ..... 224/576; 224/644; 224/647; 224/651; 224/652; 224/653

(58) Field of Search ..... 224/576, 627, 224/644, 645, 647, 651, 652, 653

(56) References Cited

U.S. PATENT DOCUMENTS 5,435,043 A 7/1995 Ito et al.
5,503,476 A * 4/1996 Hamdan ..... 383/9
5,573,166 A * 11/1996 Leja ..... 224/630
5,577,652 A 11/1996 Cooper
5,651,486 A * 7/1997 Kliot ..... 224/653
5,769,295 A * 6/1998 Alves ..... 224/613
5,826,771 A * 10/1998 Peng ..... 224/651
5,911,348 A 6/1999 Shook
5,950,895 A * 9/1999 Zakarin ..... 224/645
6,176,408 B1 1/2001 Miner et al.
D460,614 S 7/2002 Reimers et al.
6,612,472 B1 * 9/2003 Zakarin ..... 224/652
6,722,543 B1 * 4/2004 Fitzgerald et al. ..... 224/583
2001/0017308 A1 * 8/2001 Le Gal ..... 224/651

* cited by examiner

*Primary Examiner*—Stephen K. Cronin
(74) *Attorney, Agent, or Firm*—Fulwider Patton Lee & Utecht, LLP.

(57) ABSTRACT

A specialized backpack including a backpack body with a storage compartment having an openable region and a back panel including a headgear mounting flap with a cuff forming an opening through which a dome a hard-shell head gear with a rim may be passed through to retain the rim against the back panel.

24 Claims, 4 Drawing Sheets

FIG. 5
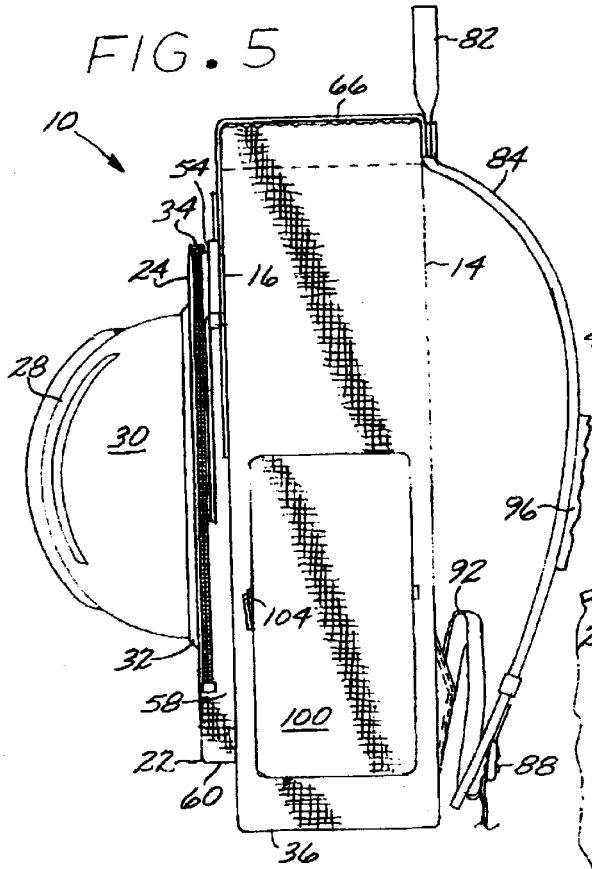
FIG. 6
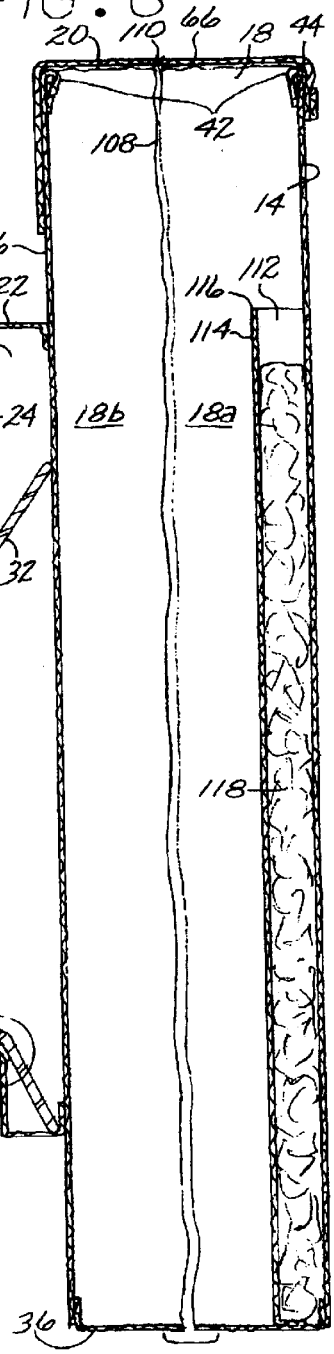
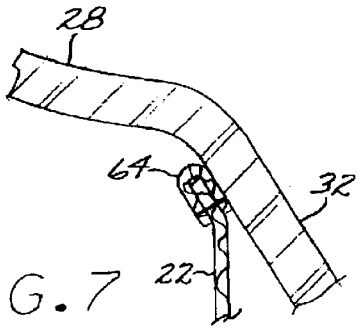
FIG. 7

BACKPACK FOR CARRYING HARD-SHELL HEADGEAR

FIELD OF THE INVENTION

This invention relates to backpacks and, more specifically, to backpacks adapted to carry headgear.

BACKGROUND

The impact of working under hazardous conditions is typically mitigated through the use of a hard-shell helmet or other protective headgear, commonly known as hard hats. Such headgear typically includes a rounded dome shaped portion and a circumferential bill projecting outwardly from the lowermost portion of the dome. When not worn, transportation and storage of headgear is relatively cumbersome. If the owner elects to hand carry the headgear to another location, only one hand remains free. If the headgear is temporarily set down it may be forgotten. Some owners elect to clip their hard hat to their belt but this allows the helmet to swing freely continuously bumping into the wearer. Merely throwing the headgear into a bag uses up most of the space in the bag and due to the helmet's configuration, presents an awkward carrying device. If such bag is a backpack, the helmet will dig into the wearer's back causing discomfort.

To date, backpack construction has not focused on facilitating the transportation of such headgear. One exception can be found in U.S. Pat. No. 6,176,408 to Miner et al. Such backpack includes a helmet receiving pocket with a soft or hard shell and a backing for carrying conventional motorcycle type helmets. However, when the helmet is inserted into the helmet receiving pocket, it takes up most of the useable space of the pack and the user is forced to place additional items into either relatively small wallet sized pockets or within the confines of the helmet.

Another example of a specialized backpack for carrying a hardshell is provided in U.S. Pat. No. 5,911,348. This backpack includes an aerodynamically configured hollow shell and a hinged lid. A pair of shoulder straps support the backpack on the user while a number of pads keep the main body of the backpack off the user's back allowing some air to pass therethrough when performing such activities as cycling. Due to the rigid shell, this backpack does not readily store in a reduced profile configuration and the aerodynamic configuration restricts available carrying capacity and the shape of the stored materials.

What is needed and heretofore unavailable, is a backpack providing significant carrying capacity adapted to carry a helmet or other headgear yet capable of being stored in a relatively small area when not in use.

SUMMARY OF THE INVENTION

In accordance with a preferred embodiment of the present invention, a backpack apparatus for carrying hard-shell head gear is provided with a backpack body having front and back panels cooperating to form a storage compartment and an openable region. A headgear retaining flap is mounted to the back panel and includes a cuff with an opening through which the dome of the head gear may pass but the rim of the head gear is restricted from passing through. A releasable attachment device secures the flap to the back panel.

Another feature of the present invention is the inclusion of an expandible collar which may expand around the dome of the head gear as it is inserted therethrough.

Other features of the present invention include shoulder straps, at least one of which incorporates a convenience pouch or auxiliary pocket. Other external compartments may also be provided.

Yet other features introduced into the present invention include an internal partition subdividing the storage compartment and a low profile pocket providing further organizational capabilities or facilitating placement of a stiffening or padded insert.

Other features and aspects of the present invention will become apparent with further reference to the following drawings and specification.

BRIEF DESCRIPTION OF THE DRAWINGS

FIG. 5 is a right hand end view thereof;

FIG. 6 is a cross section view, in enlarged scale, taken along lines 6—6 of FIG. 1 and excluding the handle and shoulder straps;

FIG. 7 is a close up view taken from oval 7 in FIG. 6;

DESCRIPTION OF THE PREFERRED EMBODIMENTS

Figure 8:
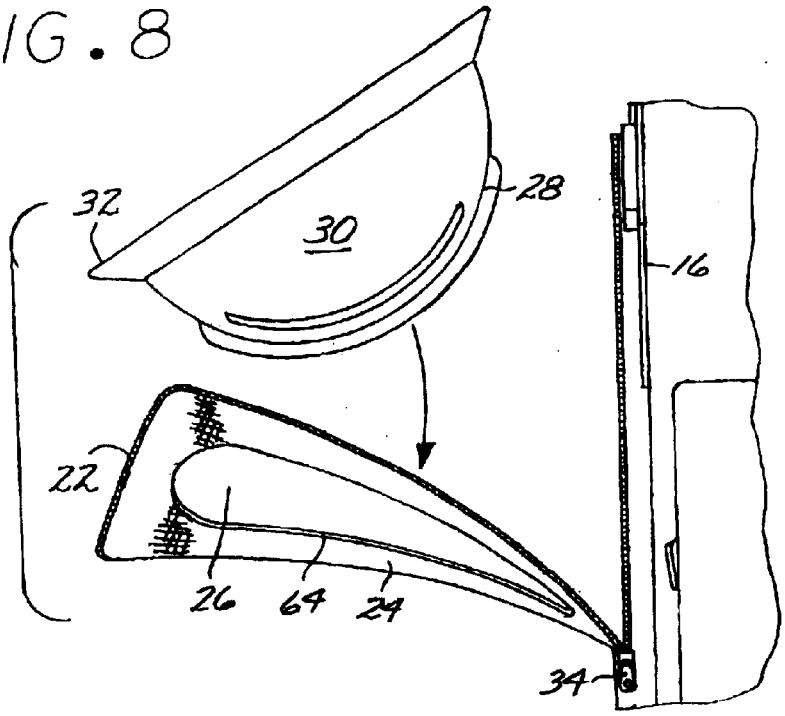
FIG. 8 is a partial exploded side view, in enlarged scale, of an exemplary head gear being inserted into the backpack illustrated in FIG. 1.

Turning now to FIGS. 1–6, a specialized backpack for carrying headgear embodying the present invention, indicated generally by the reference number 10, is illustrated. In general terms, such backpack includes a backpack body 12 having a front panel 14 and a back panel 16 cooperating to form a primary storage compartment 18 and an open region 20. Mounted to the back panel is a headgear retaining flap 22 which includes a cuff 24 with an opening 26 (FIG. 8) through which the dome 28 of a hard-shell headgear 30 may pass but restrict the rim 32 of such headgear to retain the headgear to the backpack. A releasable attachment device 34 secures the flap to the pack body.

Figure 1:
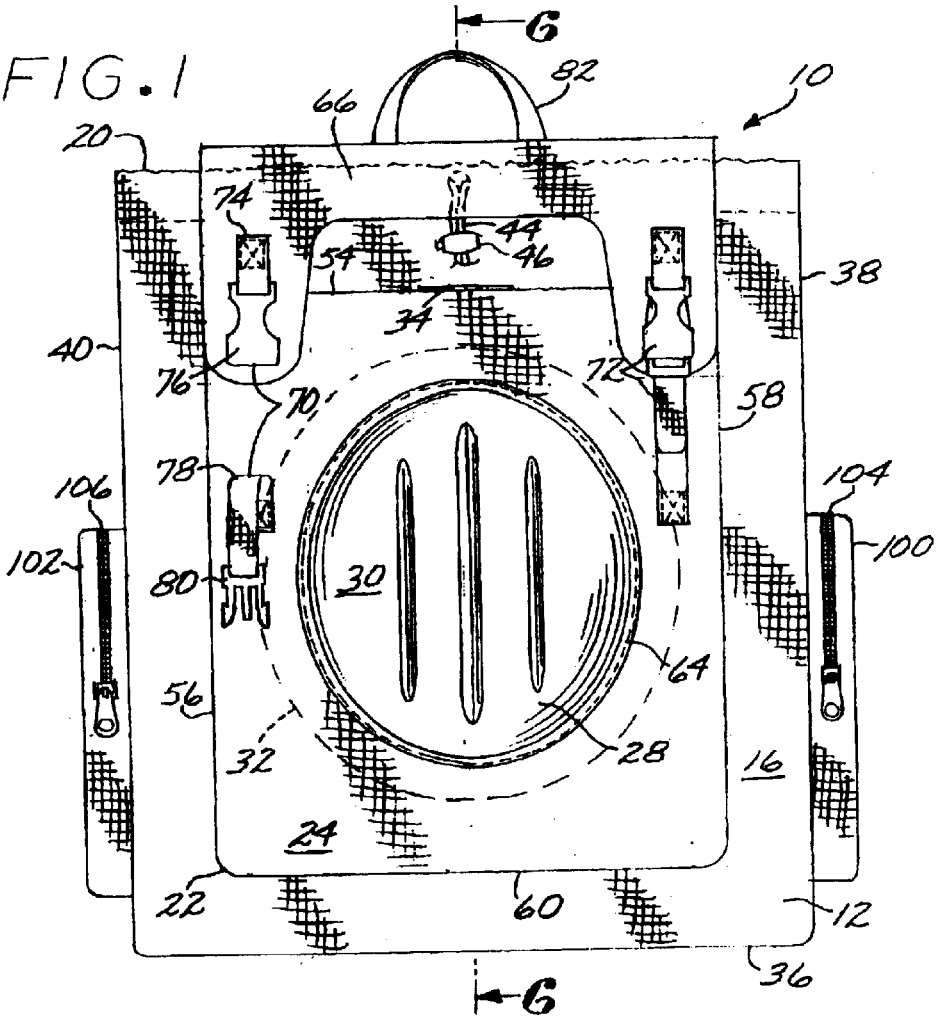
FIG. 1 is a back view of a preferred embodiment of a backpack of the present invention for carrying hard-shell head gear.
Figure 2:
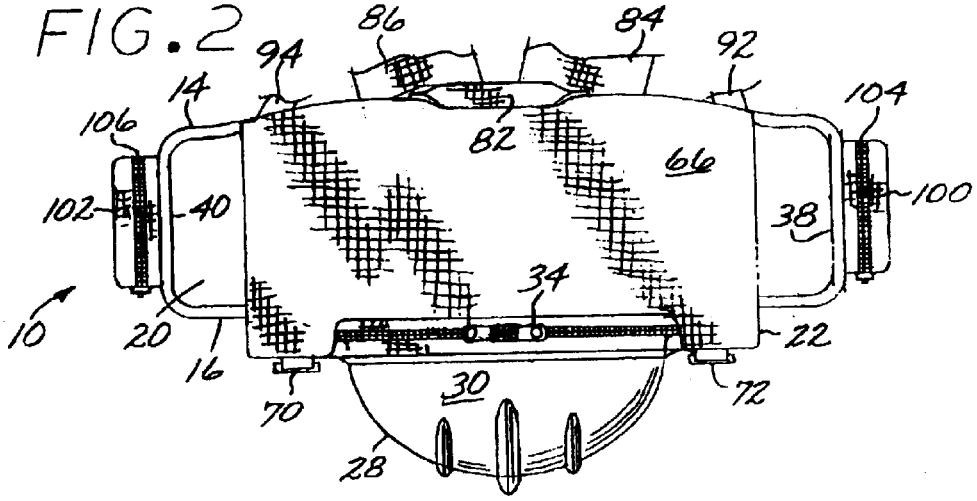
FIG. 2 is a top view thereof.
Figure 3:
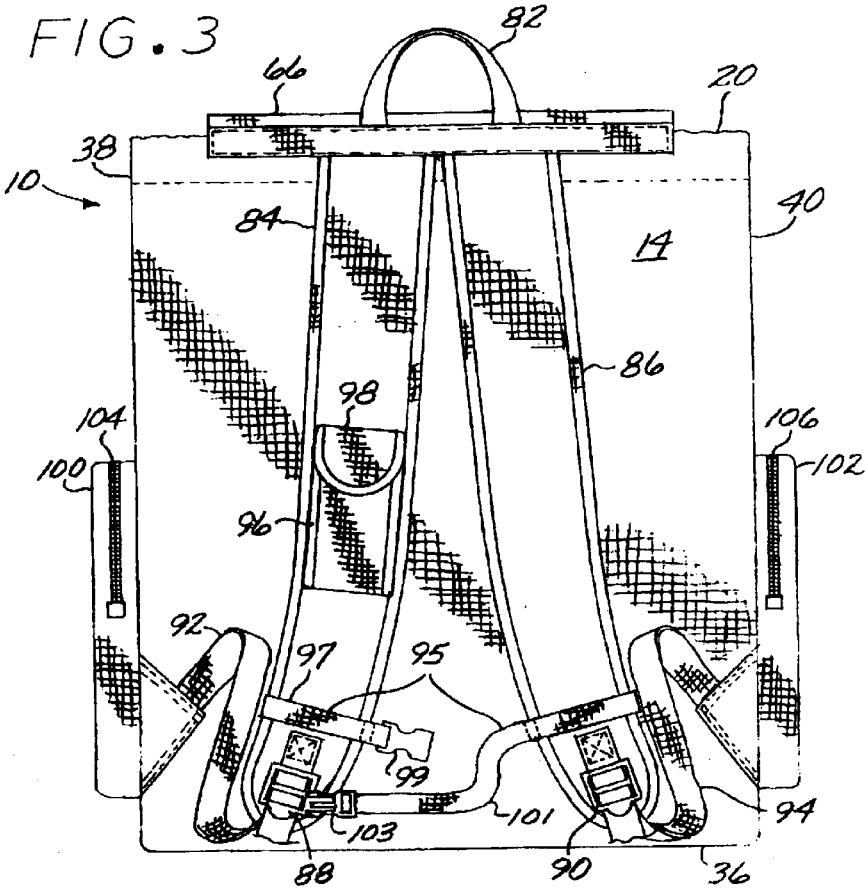
FIG. 3 is a front view thereof.
Figure 4:
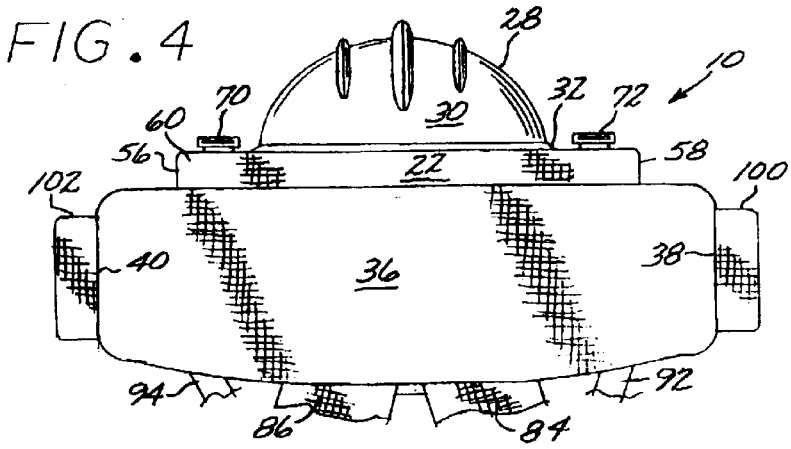
FIG. 4 is a bottom view thereof.

With continued reference to FIGS. 1–2 and also FIGS. 3 and 6, in addition to the front panel 14 and back panel 16, a bottom panel 36, a right side panel 38 and a left side panel 40, as viewed in FIG. 1, are joined together at respective seams to form the primary storage compartment 18 (FIG. 6). The front and back panels 14 and 16, respectively include confronting top edges 42 which may be separated to enable access through the openable region 20 to the contents in the storage compartment 18. It will be appreciated that other bag configurations such as a single sleeve with attached bottom, or joining front and back panels alone along three out of four sides, and other suitable bag construction arrangements would not detract from the scope and spirit of the invention. The pack body 12 is constructed of flexible material such as canvas or nylon which is preferably water repellant or treated with water repellant chemicals. Other suitable materials such as neoprene, cloth, spandex or a combination thereof for each panel or all panels may also be used. Such flexibility enables the user to roll up or fold the backpack into a relatively low profile configuration for easy storage when not in use.

Referring now to FIGS. 1 and 6, a drawstring 44 is threaded through an opening sewn into the top edges 42. The ends of the drawstring project through a grommet in the back panel 16 and pass through a string clamp 46 which releasably engages the drawstring against the back panel. Closure of the open region 20 is obtained by releasing the string clamp tension on the drawstring, pulling the drawstring taut to reduce the diameter of the open region by drawing the confronting edges 42 in close proximity, and re-engaging the string clamp.

While the storage compartment 18 is selected to be of a suitable size to accommodate various articles such as clothing, magazines, business papers, small tools, and other personal belongings, and accommodate placement of the hard hat 30 even when the backpack is closed, it is preferable to store the hard hat outside the main compartment 18 to free up space in the backpack 10. It is also preferable to carry the unworn hard hat in the backpack so that is not left inadvertently left behind.

With reference to FIGS. 1–2 and 5–6, advantageously, the backpack of the present invention as exemplified in FIG. 1 incorporates the headgear retaining flap 22 secured to the back panel 16 of the backpack body 12 for carrying the headgear on the pack body 12 outside of the primary storage compartment 18. The headgear retaining flap 22 is flexible and generally rectangular in shape and is secured to the back panel 16 by the releasable attachment device 34. In this exemplary embodiment, the releasable attachment device is a dual zipper closure with one-half sewn into the back panel and the complementary half sewn into the flap 22. The zipper closure extends around three sides of the flap 22 including the upper side 54 and left and right sides, 56 and 58, respectively, as viewed in FIG. 1. The bottom side 60 of the flap 22 is sewn directly into the back panel. Thus, the flap 22 in conjunction with the back panel form a distensible, headgear carrying pouch providing a headgear storage compartment 48 (FIGS. 6 and 9) for storing a portion of the hardhat 30 as will be discussed below in more detail. The flap 22 is openable along its top and side edges so that a user may unzip the flap and peel the top edge 54 and opposing left and right sides 56 and 58, respectively, away from the back panel 16 while the bottom edge 60 retains the flap to the backpack body 12. Other suitable releasable attachment devices 34 such as complementary hook and loop fasteners, complementary hook and eye fasteners, complementary buttons and buttonholes, complementary snaps, complementary buckles, and complementary clips may also be used in place of the zipper 34.

Referring now to FIGS. 1 and 5–9, the flexible flap 22 includes the cuff 24 with the cuff opening 26 (FIG. 9) being defined by a generally circular collar 64 formed of an elastic material. As most headgear used in the construction industry includes a dome 28 of a standard size, the collar will typically have a relaxed diameter of less than the largest diameter of a standard headgear dome 28 and is expandable to a diameter equal to or greater than the headgear dome 28 or somewhere in between. For example, it has been found that a collar 64 that measures approximately 6–8 inches in diameter in an un-expanded or relaxed state and stretches an additional two inches in diameter will accommodate most helmet 30 sizes. Within this range a collar measuring approximately 7 inches in diameter in an un-expanded state which can stretch to approximately 9 inches in diameter in an expanded state will satisfactorily stretch to slide over a standard sized dome 28. When the collar 64 is in an expanded state, the dome 28 protrudes through the cuff opening 26 and the collar 64 encircles the dome at its base next to the rim 32 to releasably retain the headgear 30 to the backpack 10 by interfering with the projecting rim 32. In this expanded state, the flap 22 is collapsed against or near the back panel 16 to reduce the profile of the distensible pouch (FIGS. 5–6) to snugly fit the collar against the rim 32. With a headgear 30 in place and retained by the cuff 24, the cuff opening 26 is closed off and additional items may be placed inside the headgear compartment 48 inside the dome area of the headgear. As the headgear is retained relatively tightly against the back panel, the contents are held a relatively ordered fashion in the dome area.

Other convenient features are also provided with the specialized backpack 10. Referring to FIG. 1 for instance, while the drawstring 44 enables a user to draw the confronting top edges 42 together to close the open region 20 by releasing the string clamp tension on the drawstring, pulling the drawstring taut, and re-engaging the string clamp, a flexible top cover 66 is also provided to protect contents in the storage compartment 18. The top cover 66 is selected from similar material as the panels of the backpack body 12 and has one end sewn to the upper portion of the front panel 14 and a free end 68 which may be releasably attached to the back panel with a set of left and right complementary clip assemblies, 70 and 72, respectively as viewed in FIG. 1. Each clip assembly includes complementary fastening components and is constructed in similar fashion. For example, the left buckle 70 in this embodiment includes an upper strap 74 secured at one end to the outer side of the cover 66 and terminating at its opposite end in a clip receiver 76. A lower strap 78 is sewn into the retaining flap 22 at one end and includes a clip 80 at its free end to be complementally inserted into the clip receiver 76. The right clip assembly 72 is constructed in a like manner. FIG. 1 illustrates an unfastened left buckle 70 and a fastened right buckle 72. The free end 68 of the top cover 66 may be releasably fastened to the backpack body 12 by fastening both clip assemblies 70 and 72. The cover length is selected to cover the entire top opening 20 from front to back when the storage compartment 18 is full. The drawstring 44, when pulled taut, pulls the side walls 38 and 40 underneath the top cover as well so the open region 20 of the backpack 10 is completely covered. A convenient carrying handle 82 is also sewn into the top region of the back panel 16 so a user may hand carry the backpack.

Referring now to FIG. 3, while the backpack may be hand carried, it is frequently preferable to wear the backpack 10 over one's shoulders in conventional fashion to distribute the weight of the contents carried in the main compartment 18 and headgear compartment 48. Conveniently, the front panel is provided with a left shoulder strap 84 and a right shoulder strap 86 as viewed in FIG. 3, both of which are secured by sewing or other suitable attachment method to the respective left and right top and bottom regions of the front panel 14 such that the front panel 14 rests against the user's back when the backpack 10 is worn. While the upper ends of the respective shoulder straps 84 and 86 are typically sewn directly to the upper end of the front panel, the lower ends of the shoulder straps include left and right buckles 88 and 90, respectively, for receiving a portion of the free ends of strap extenders 92 and 94, respectively, for slidably adjusting the loop diameter of the straps by securing the buckles at different lengths along the extenders to accommodate different sized backpack users. The opposing ends of each extension 92 and 94 are also sewn into the lower portion of front panel 14 near the respective left or right side.

The left and right shoulder straps 84 and 86 include complementary portions of a waist belt 95. More specifically, a left side waist strap 97 of the waist belt is secured to the left shoulder strap near the bottom and terminates in a free end with a waist buckle 99. A right side waist strap 101 is secured to the right shoulder strap and includes a free end with a complementary waist clip 103 for releasable insertion into the waist buckle. When the waist clip and waist buckle are connected together after the user dons the backpack 10, a continuous waist belt is formed between the front panel 14, extensions 92 and 94, and waist belt 95 to encircles the user's waist and stabilize the backpack against the user. Alternatively, the belt may be connected at a higher portion of the shoulder straps to be secured across the user's chest.

With continued reference to FIG. 3, it will be appreciated that middle of either the left or right shoulder strap, 84 or 86, will be located over the torso of the backpack user when worn and is easily accessible to the user. Taking advantage of the location of the straps, an open topped convenience pocket 96 with top flap closure 98 is fixed by sewing or other suitable fashion to the outwardly facing surface of the left shoulder 84. The top flap closure includes a free end releasably secured to the front surface of the convenience pocket with a snap or hook and loop fastener or other suitable fastener including any mentioned herein. Such pocket is approximately the width of the shoulder strap itself and further sized to accommodate a cellular phone, writing utensils, note pads, and other handy items. The convenience pocket may be wider than the strap it is attached to but is preferably no wider than the strap and less than the entire length of the strap. Other pockets may be placed at other locations along the outwardly facing surface of either strap.

Referring now to FIGS. 1–5, a right auxiliary pouch 100 and a left auxiliary pouch 102, as viewed from FIG. 1, are attached to the respective right and left side panels 38 and 40. Each pouch is generally rectangular and located on its respective panel with its upper edge near the midpoint of its respective side panel and projecting to near the bottom edge. The right and left pouches include a zipper closure 104 and 106, respectively, extending around the top and part way down the sides of each pouch which may be unfastened to access the interior of the pouch. Such auxiliary pouches 100 and 102 add to the overall storage capacity of the backpack 10 in addition to the main compartment 18, headgear compartment 48, and convenience pocket 96 storage space.

In addition to the compartmentalization provided by the various pockets and pouches on the exterior of the backpack body 12, the interior of the backpack 10 may include a single primary storage compartment 18 or, as in this exemplary embodiment, include multiple compartments to further facilitate the organization of the contents placed in the backpack. Referring to FIG. 6, the primary compartment 18 includes a number of convenient features for segregating articles placed thereinto such as a vertical partition 108 anchored at its bottom end to the bottom panel 36 of the backpack body 12 in the primary compartment to project vertically upwardly such that its top edge 110 is disposed at a height near the top edges of the opposing front and back panel top edges 42. Such partition subdivides the primary storage compartment into two equal sized front and rear compartments 18*a*, 18*b*. As such backpacks will often be used at construction sites or other locations wherein a hardhat 30 is required, this dual compartment arrangement for the placement of clean and dirty clothing will be appreciated by the backpack user. Other uses will occur to the backpack user.

With continued reference to FIG. 6, an internal low profile top opening pocket 112 is formed between the front panel 14 and truncated partition 114 secured to the bottom panel 36 and spanning the width of the primary compartment 18 and attached to the right and left side panels 38 and 40, respectively. The truncated partition includes an upper edge 116 recessed below the upper edges 42 of the backpack body 12 and spaced in close proximity with the front panel to provide a low profile when viewed from the side as in FIG. 6 or from above. The low profile of this internal pocket 112 facilitates placement of flat materials such as magazines, business plans, blueprints or other relatively flat materials and reduces the likelihood of significantly bending such materials. Alternatively or in addition to, this pocket 112 may be used to receive an insert 118. Such insert could range in flexibility from rigid to provide a stiffener to relatively soft padding to act as cushioning. The insert may easily be replaced by withdrawing it from the low profile pocket and inserting a new one. Alternatively, the front panel may include a hollow space wherein the insert could be placed.

Figure 9:
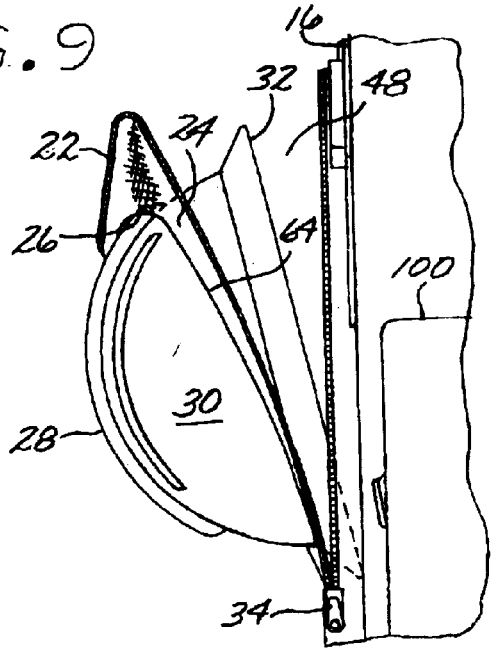
FIG. 9 is a similar view as in FIG. 8 with the headgear inserted further into the backpack.

Referring to FIGS. 1–2 and 8–9, in use, backpack user takes off the headgear 30 to be stored in the backpack 10. With the backpack 10 in a generally upright position, the user grasps the dual zipper assembly 34 and pulls them away from another to open the distensible pouch along the top side 54 and left and right sides 56 and 58 to release the retention flap 22. The retention flap is then peeled back away from the back panel 16 of the backpack body 12 (FIG. 8) revealing the headgear compartment 48 (FIGS. 6 and 9). While holding the upper edge 54 of the retention flap 22, the user inserts the headgear 30 with its dome portion 28 facing outwardly and downwardly into the distensible pouch aligning the dome with cuff opening 26 (FIG. 9). With the dome in a generally downward configuration, the user may place some materials into the open dome region inside the helmet such as gloves or other suitable items for storage. The retention flap is then resecured to the back panel 16 by zipping the zipper element 34 together along the three sides of the flap 22 securing the headgear and any contents within the headgear compartment 48. At this point the flexible flap 22 is generally bulging around the dome 28 and collar 64 partially encircles the outermost portion of the dome in a generally unexpanded state.

While it will be appreciated that the headgear will be retained in this position and will not fall through the cuff opening 26 and out of the headgear compartment 48 when the flap 22 is closed, it is preferable to slide the collar 64 down over the dome 28 until the collar rests against the rim 32. To accomplish this, the user places both hands on the collar or surrounding flap area and presses it toward the back panel 16. The collar 64 expands outwardly enlarging the cuff opening 26 to accommodate the increasing diameter of the dome as the retention flap 22 is pressed toward the back panel. Once the flap 22 has been pressed far enough toward the back panel such that the collar rests against the rim of the headgear (FIG. 7), the user may stop. This expanded collar fits snugly around the base of the dome and the headgear compartment 48 provides a low profile top and side view as illustrated in FIGS. 2 and 4–6.

The user may also elect to store additional components in the backpack 10 by disengaging the left and right buckles 70 and 72, respectively of the top cover 66 and peeling the top cover back away from the top edges 42 of the backpack body 12. Assuming it is pulled taut, the drawstring 44 is relaxed by disengaging the string clamp 46 and the confronting edges 42 are pulled away from one another to expose the open region 20 of the backpack body 12. Contents are placed to either side of the partition 108 and into the low profile pocket 112 within the storage compartment as desired. The drawstring is then pulled taut to bring the confronting top edges 42 together and the spring clamp engaged to close the storage compartment 18. The top cover 66 is then flipped back over the closed storage compartment and the left and right buckles 70 and 72 re-engaged.

The auxiliary pouches 100 and 102 may also be filled by unzipping their respective zippers 104, 106 and placing the desired contents therein. The zippers are then re-engaged closing the pouches. The interior of the convenience pocket 96 may be accessed by peeling back the pocket flap 98 to insert a cell phone or other desired device or material therein and reclosed.

The backpack is then lifted by one of the shoulder straps 84 or 86 and donned conventionally. The use may adjust the strap length by decreasing or increasing the length of the respective extenders 92, 94 passing through the respective shoulder strap buckles 88, 90. If desired, the waist belt 95 may also be engaged by inserting the clip 103 into the waist buckle 99 and adjusting the right side waist strap 101.

While the present invention has been described herein in terms of a number of preferred embodiments for hard-shell headgear in a backpack, various changes and improvements may also be made to the invention without departing from the scope thereof. For instance, the collar may be non-expandable and the cuff opening selected to be of a diameter of less than the largest diameter of the dome portion of the hard hat to retain the hard hat to the backpack when the releasable attachment device attaches the flap to the back panel. Such construction would retain a hard hat without a bill or rim extending away from the dome as the dome typically expands outwardly. In such construction, the distensible pouch will maintain a bulging shape and does not lay flat. The retention flap may be also completely removable. In addition, it is also contemplated that a drawstring similar to the top region drawstring described above and passing through the collar may be incorporated instead of elastic to draw the collar snugly against the base of the dome and restrict the rim of the helmet from falling through the cuff opening.

What is claimed is:

1. A backpack apparatus for carrying a hard shell head gear configured with a dome and a peripheral rim, said backpack apparatus comprising:

a backpack body constructed with front and back panels cooperating to form a storage compartment and configured with an openable region;

a headgear retaining flap mounted to the back panel and including a cuff with a circumferential expandible collar forming an opening for passage therethrough of said dome and configured to retainly engage said rim to hold said rim in place positioned against said back panel; and a releasable attachment device for attaching said flap to said back panel.

2. The backpack apparatus as set forth in claim 1 wherein:

said attachment device is a zipper.

3. The backpack apparatus as set forth in claim 1 wherein:

said fastening device is in the form of a closure device extending the majority of way around said flap.

4. The backpack as set forth in claim 1 wherein:

said releasable attachment device is selected from a group consisting of complementary hook and loop fasteners, complementary hook and eye fasteners, complementary buttons and buttonholes, complementary snaps, complementary buckles, and complementary clips.

5. The backpack as set forth in claim 1 further including:

a partition anchored to a bottom of said storage compartment and projecting vertically between said front and back panels to terminate in an upper edge proximate said openable top region.

6. The backpack as set forth in claim 1 further including:

an internal top opening storage pocket secured to an inside surface of said front panel and having a slim profile, when viewed from above, for receiving relatively flat materials.

7. The backpack apparatus as set forth in claim 1 wherein:

said expandible collar is elastic.

8. The backpack as set forth in claim 1 wherein:

said expandible collar is preselected to be stretchable from a diameter less than a major diameter of a pre-measured headgear to a diameter equal to or greater than said major diameter.

9. The backpack as set forth in claim 1 wherein:

said collar measures approximately 6–8 inches in diameter when in an un-expanded state and approximately 8–10 inches in diameter in an expanded state.

10. The backpack as set forth in claim 1 wherein:

said collar measures approximately 7 inches in diameter when in an un-expanded state and approximately 9 inches in an expanded state.

11. The backpack as set forth in claim 1 wherein:

said pack body includes a front panel, a back panel, opposing side panels and a bottom panels cooperating to form said storage compartment.

12. The backpack as set forth in claim 1 wherein:

said backpack body is formed of a flexible material selected from the group consisting of canvas, nylon, neoprene, cloth, and spandex.

13. The backpack as set forth in claim 1 further including:

a compartment closure element mounted to said front and back panels for opening and closing said openable top region.

14. The backpack as set forth in claim 13 wherein:

said compartment closure element is selected from the group consisting of drawstrings, zippers, buttons, snaps, buckles, flaps, hook and eye fasteners, and hook and loop fasteners.

15. The backpack apparatus as set forth in claim 1 wherein:

said headgear retaining flap and said back panel cooperate to form a distensible headgear carrying pouch.

16. The backpack as set forth in claim 15 wherein:

said collar being expandible to slide over said dome to collapse said pouch flap against said back panel when said headgear is carried in said pouch in a dome facing outwardly configuration.

17. The backpack as set forth in claim 1 wherein:

said front panel includes a hollow compartment; and a padding insert resides in said hollow compartment.

18. The backpack as set forth in claim 17 wherein:

said padding insert is formed of semi rigid material.

19. The backpack as set forth in claim 17 wherein:

said padding insert is formed of a rigid material.

20. The backpack apparatus as set forth in claim 1 further including:

at least one elongated shoulder strap attached at opposing ends to a top and a bottom of said front panel.

21. The backpack as set forth in claim 20 wherein:

said shoulder strap has a predetermined width and height and includes an auxiliary pocket with a width and height equal to or less than said predetermined width and height.

22. The backpack as set forth in claim 20 wherein:

said pack body includes a left side shoulder strap and a right side shoulder strap secured to said front panel.

23. The backpack as set forth in claim 1 further including:

a waist belt including a buckle connected to a lower extent of each of said shoulder straps and cooperating with said back panel and shoulder straps to encircle a user's waist when the backpack in donned.

24. A backpack for carrying headgear having a dome portion terminating along at least a portion of its base in an outwardly projecting rim, said backpack comprising:

a pack body including a front panel, a back panel, a bottom panel and two side panels constructed of a flexible material and cooperating to form a primary storage compartment with an openable top region;

a partition anchored to said bottom panel subdividing said primary storage compartment;

a layer of padding material inserted into a pocket in said front panel;

a first fastener secured to said back panel;

a flexible flap anchored at one end to said back panel and including a second fastener at an opposing end, said second fastener being operably registrable with said first fastener for releasably engaging said flap to said back panel forming a headgear retaining pouch when said fasteners are engaged, said flap further including a retaining cuff with an expandible collar being selectively operable between an unexpanded position with said flap distended away from said back panel, and an expanded position with said flap collapsed against said back panel;

a pair of shoulder straps secured to said front panel;

an auxiliary pocket attached to at least one of said shoulder straps; and whereby a user may disengage said first and second fasteners and upon inserting said headgear into said pouch with said dome portion facing outwardly, slide said expandible collar over said dome portion until said flap collapses against said back panel and said collar is disposed in covering relation with said rim and reengage said first and second fasteners to releasably retain said headgear in said pouch.

* * * * *